US005222442A

United States Patent [19]

Tack, Jr.

[11] Patent Number: 5,222,442

[45] Date of Patent: Jun. 29, 1993

[54] TORSION BAR RAILWAY TRUCK

[75] Inventor: Carl E. Tack, Jr., Oak Park, Ill.

[73] Assignee: Trans-Dyne Incorporated, Chicago, Ill.

[21] Appl. No.: 923,239

[22] Filed: Jul. 30, 1992

[51] Int. Cl.[5] ..... B61F 5/00

[52] U.S. Cl. ..... 105/218.2; 105/179; 105/182.1; 105/206.1

[58] Field of Search ..... 105/218.2, 157.1, 167, 105/168, 179, 182.1, 194, 198.6, 206.1, 209, 210

[56] References Cited

U.S. PATENT DOCUMENTS

| | | | |
|---|---|---|---|
| 2,545,956 | 3/1951 | Julien | 105/218.2 |
| 4,362,109 | 12/1982 | Panagin | 105/218.2 |
| 4,658,734 | 4/1987 | Mroz | 105/218.2 |

FOREIGN PATENT DOCUMENTS

| | | | |
|---|---|---|---|
| 1186490 | 2/1965 | Fed. Rep. of Germany | 105/218.2 |
| 3930873 | 1/1991 | Fed. Rep. of Germany | 105/218.2 |

*Primary Examiner*—Mark T. Le

*Attorney, Agent, or Firm*—Juettner Pyle & Lloyd

[57] ABSTRACT

A railway truck has frames on each side divided into separate components or lever arms extending from the axles. Opposed arms are secured together by a pair of parallel torque tubes. A bolster rides on the tubes and maintains the tubes in parallel and provides frictional damping. The torsion tubes each carry a pair of torsion bars secured at the inner end to the torque tube and to the outer end to the bolster. Unequal loads on opposite wheels are carried equally by the torsion tubes.

14 Claims, 2 Drawing Sheets

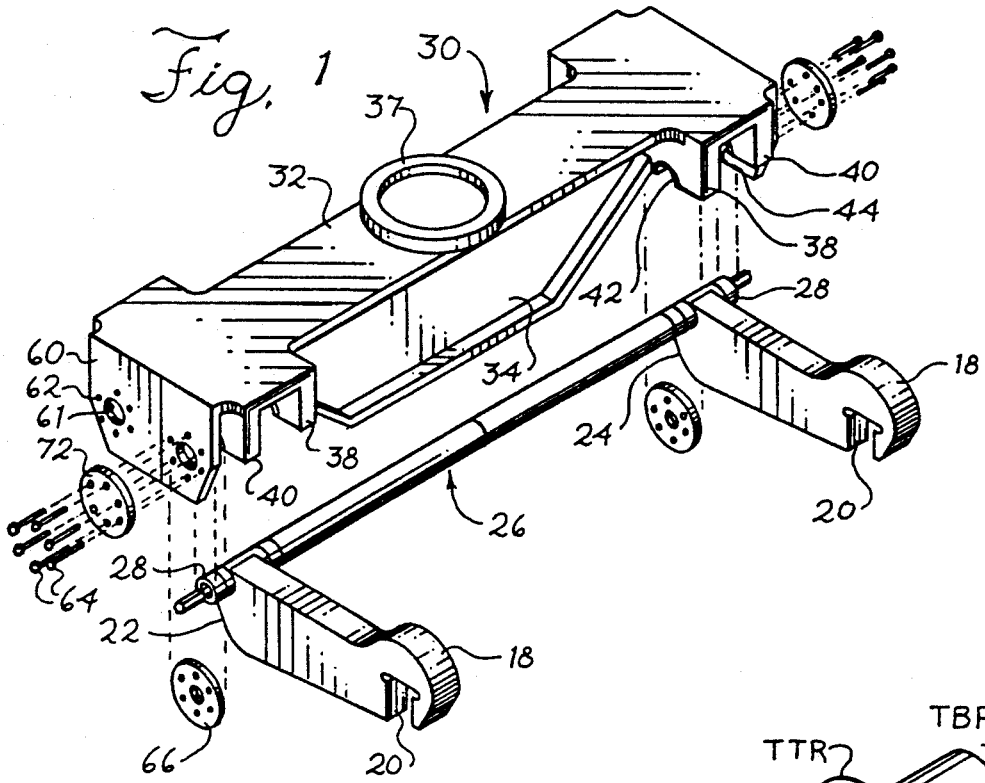
Fig. 1
Fig. 6
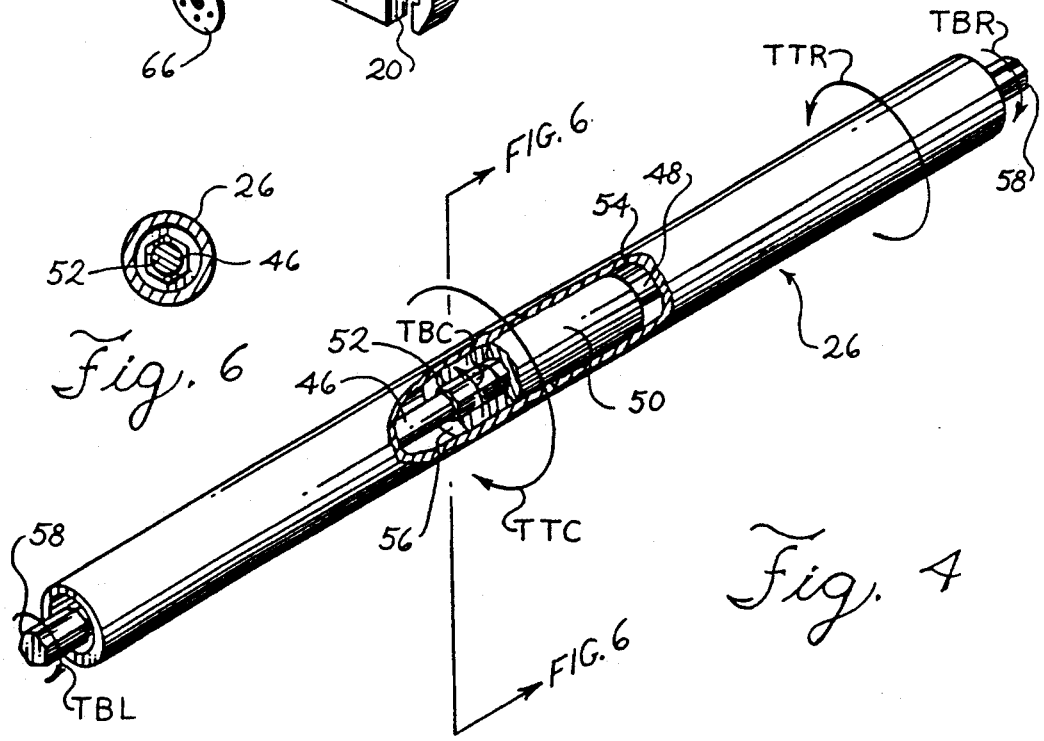
Fig. 4

TORSION BAR RAILWAY TRUCK

BACKGROUND OF THE INVENTION

This invention relates to railway rolling stock and more particularly to railway trucks, which ride on rails and provide support for car bodies.

Many of the design features of railway trucks have remained the same over the past century, with improvements being made primarily in refinement of individual components and scaling up of the components for carrying higher capacities. A conventional truck comprises a pair of spaced parallel unitary side frames which are supported near their ends on wheel and axle assemblies. A transverse bolster centrally connects the side frames, and the ends of the bolster are supported on helical springs carried in opposed side frame windows. The bolster resiliently supports the car body. Mechanical snubbers are employed to dampen vertical movements of the bolster, and shoes are carried by the bolster and frictionally engage vertical columns on the side frame.

While the prior art is crowded with many suggestions to improve the ride and performance of so-called three piece trucks of the foregoing nature, many problems have remained unresolved, presumably due to characteristics inherent in the design. The side frames, which form rigid connections between the front and rear wheels on each side of the truck, are heavy castings. This necessarily results in a high unsprung weight between the wheels and bolster, contributing to poor riding qualities. The two trucks beneath the car may contribute up to forty percent of the tare weight of the total structure.

A second problem with existing truck designs is unlevel riding qualities under varying speeds, loads and track conditions. One example is a phenomena of rock and roll, in which the car body and trucks may rock from side to side to a dangerous degree.

Another problem is the inability of present designs to maintain a square condition because of the H relation between the side frames and the bolster. The bolster has portions in slidable engagement with columns of the side frame, and these parts tend to wear over a period of time. The design contributes to the problem known as hunting, in which the wheels on one side of the truck may precede the wheels on the other side and cause an erratic ride. The problem may become intensified as the relevant parts become worn.

Finally, conventional railway trucks contain numerous cooperating parts which must be carefully engineered in order to perform in a satisfactory manner, all contributing to cost. Notwithstanding all these problems and more, there has been a reluctance to deviate or make fundamental departures from the current basic design.

SUMMARY OF THE INVENTION

An object of this invention is to provide a railway truck having greatly improved and level ride characteristics, irrespective of loading, speed and track conditions.

Another object is to provide a truck having a substantially lower unsprung weight and yet same capacity of conventional designs.

A further object is the provision of a railway truck which is inherently square in design and contains features which positively maintain a square relation between the wheels in a reliable manner.

Another object is to provide the wheels of a truck with independent suspension wherein the forces on opposed wheels is summed by a common connecting member.

A still further object of this invention is to provide the sprung portions of such a truck with effective damping without the use of separate snubbers and associated parts.

Another object is to provide a railway truck of simplified design, having fewer working parts as well as fewer parts which are subjected to wear, thereby reducing manufacturing and maintenance costs.

The foregoing objects are generally accomplished by eliminating the one piece side frame on each side of the truck in favor of separate independent frames in the form of lever arms having one end journaled on the axle and the other ends extending toward each other on each side of the truck. Opposed lever arms on opposite sides of the truck are connected by transverse torsion tubes extending across the truck in parallel on either side of the transverse center line of the truck. A bolster rides on and frictionally engages the tubes near the ends thereof in order to hold the tubes in a parallel relation and hence the components of the truck in a square relation. At the same time, frictional engagement between the bolster and tubes, which occurs during vertical motion of the bolster and rotary motion of the tubes, provides effective damping, with increased friction at heavier loads. Each torsion tube carries a pair of torsion bars. The inner ends of the torsion bars are secured at the center of the tubes, and the outer ends are secured to the bolster ends. The torsion bars thereby serve as the spring component of the truck.

As a result of the foregoing configuration unequal forces on opposed wheels are divided equally between the two torsion bars, acting under the influence of the torsion tube and associated lever arm frame. The result is a truck having a level ride.

Since the lever arm frames are connected directly to the torsion tubes and bars, the truck has a low unsprung weight. The bolster holds the two ends of the truck in a square relation, thereby minimizing hunting problems. Unlike conventional designs, the side frame components are not subjected to frictional wear, and any wear between the bolster and torsion tubes does not cause loss of ride qualities.

THE DRAWINGS

FIG. 1 is a perspective view of the bolster and one of the torsion and side frame assemblies of the railway truck of the present invention, with the bolster and assembly shown in a separated condition for the sake of clarity.

FIG. 4 is a perspective view of the torsion bar and torque tube assembly of the present invention, with a portion being cut away to reveal the inner structure.

FIG. 6 is a sectional view through line 6—6 of FIG. 4.

DESCRIPTION OF THE PREFERRED EMBODIMENTS

Figure 3:
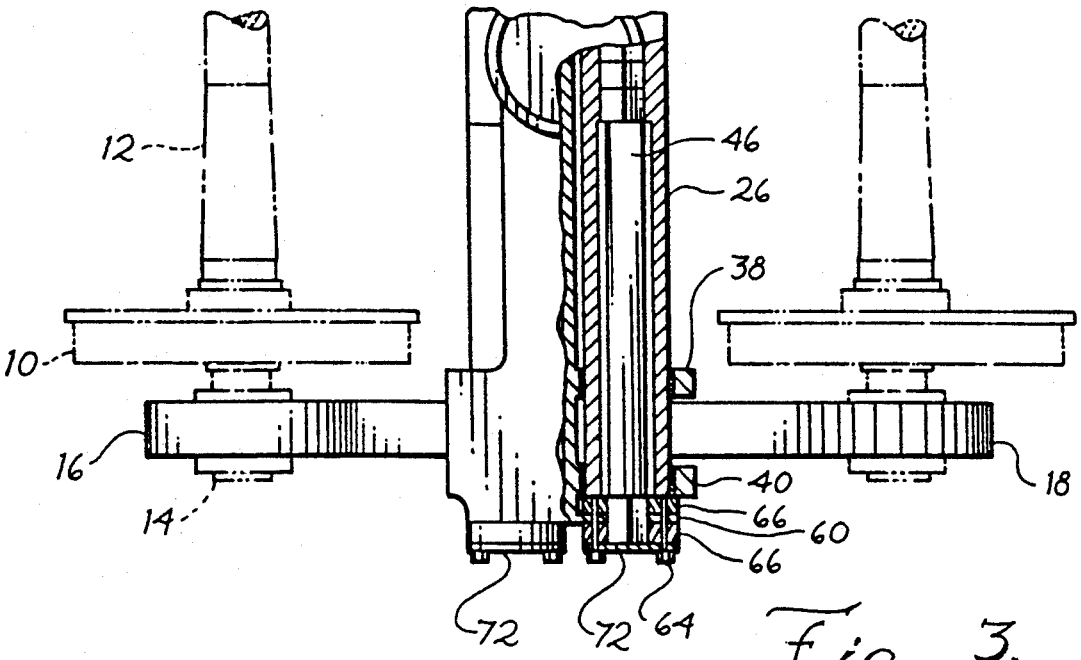
FIG. 3 is a top view of the truck with a portion shown in partial section.
Figure 2:
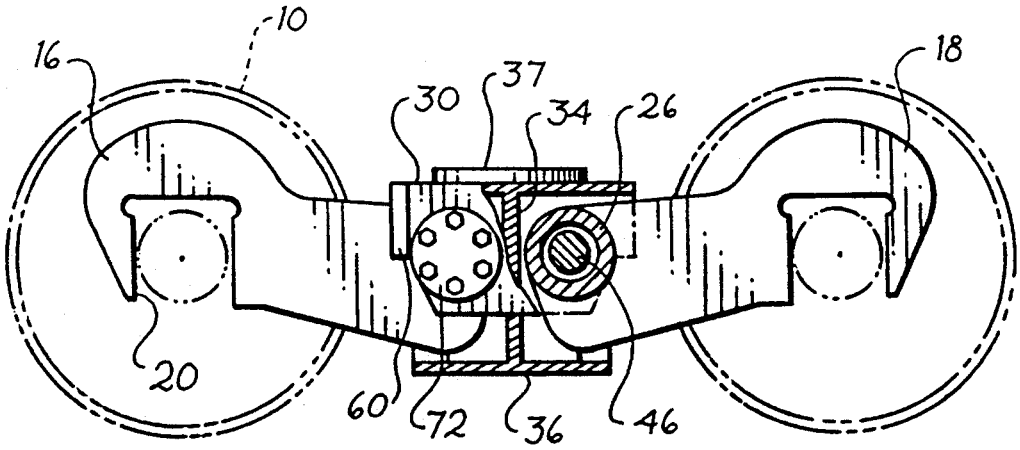
FIG. 2 is a side view of the truck with a portion shown in section.

As shown in FIGS. 1-3, the truck includes conventional wheel and axle assemblies, in which opposed wheels 10 are secured to an axle 12 and journaled to an associated frame member by means of conventional rotary bearings 14 between the end of the axle and frame member. Although only one side of the truck is shown, it will be understood that the other side is identical to the illustrated portion. Likewise, both ends of the truck connected by the bolster are identical.

Each end of the truck comprises pairs of opposed rigid frame members 16 and 18 having conventional pedestal openings 20 having the usual bearing adaptor (not shown) for engagement with the bearings 14. The frame members 16 and 18, having a length less than one half the length of the truck, terminate in free ends 22 and 24, and said ends, on opposite sides of the truck, are connected by a transverse torque tube 26 secured at each end to a respective frame member and having portions 28 thereof extending outwardly beyond the frame members. The other end of the truck is provided with an identical assembly, with the torque tubes being arranged in parallel on a horizontal plane on either side of the transverse central axis of the truck.

A unitary bolster 30 is provided with an upper horizontal wall 32 and a depending central vertical web 34 of T-shape fabricated construction, as shown. In the alternative, the bolster 30 may be of I-beam construction, with a bottom horizontal wall 36 as shown in FIGS. 1 and 2 secured to the bottom of web 34. The bolster 30 is of a simpler design than conventional designs, which are of cast construction with a box section to provide adequate structural support. The bolster has a female center plate 37 for carrying the male center plate of the car body (not shown).

A pair of downwardly depending flanges 38 and 40 are provided near each end of the bolster 30. Respective flanges 38 and 40 have downwardly facing concave or semi-circular bearing surfaces or walls 42 and 44 which embrace and rest on the torque tube 26 and its extension 28 on either side of the frame 16 and 18. The walls 42 and 44, as well as corresponding surfaces on the tube, may be designed such that they may be replaced in the event of the excessive wear, such as use of the wear liners as shown.

It may be seen that the bolster 30 positively holds the torque tubes 26 in a parallel relationship. The friction between the bolster and torque tubes increases with increasing loads on the bolster to provide progressive damping.

As best shown also in connection with FIGS. 4 and 6, a pair of torsion bars or shafts 46 and 48 are received in each torque tube 26. As shown in FIG. 4, the center of the tube is provided with an insert 50 secured in the tube and having a pair of hexagonal sockets 56 adjacent to the slug on either side thereof. An enlarged nut or slug 52 and 54 is secured on the inner end of each torsion bar 46 and 48 and is slidably received in the sockets 56. The outer ends of torsion bars 46 and 48 terminate in enlarged multifaceted or hexagonal ends 58, which are secured to the ends of the bolster, as described below.

Figure 5:
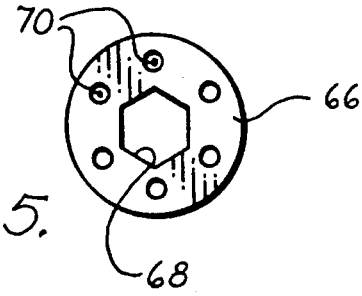
FIG. 5 is a plan view of one of the spacer plates employed to secure the torsion bar to the bolster.

As shown in FIGS. 1-3, a third outermost wall 60 depends downwardly from the top wall 32 of the bolster 30 and is provided with a central opening 61 and a number of openings 62 to receive bolts 64. As shown in FIGS. 1, 3 and 5 plates 66 having hexagonal openings 68 and bolt holes 70 are disposed on either side of the outer bolster web or flange 60. As shown in FIG. 1, the innermost plate 66 has threaded openings to engage with the threaded ends of the bolts.

Upon insertion of the torsion bars 46 and 48, the outer faceted end is secured to the bolster wall 60 by means of the plates 66 and bolts 64 received through an outer cap 72. Thus, the outer ends of the torsion bars 46 and 48 are anchored relative to rotary motion of the torque tube 26. The torque tubes 26 have a torsional stiffness in the order of 10 to 20 times the stiffness of the torsion bars 46 and 48, so the torsion bars provide the primary springing for the truck and are enclosed and are protected by the torque tube. The torque tubes also prevent lateral displacement between the bolster and the side frame members.

In actual use, the bolster may be designed for up to 4.5 inch or greater vertical travel relative to the axles. Under empty car conditions, the downward travel would be less than one quarter available travel. Under loaded conditions, the travel would be in the order of three quarters of total available travel.

It may be seen that as the bolster 30 moves downwardly due to loading, the torque tube 26 rotates. For example, the forward tube will rotate in a counterclockwise direction and the rear tube will rotate in a clockwise direction. This motion applies torque on the torsion bars 46 and 48, which progressively and resiliently resist such movement.

From a different perspective, assume that there are unequal loadings on the front wheels, for example, due to unequal weight distribution in the car body or track irregularities. This will result in unequal forces at the wheels and unequal torques at the ends of the torque tube 26.

FIG. 4 includes an illustration of the torques on the various components. Assuming that the torques TBL and TBR on the outer ends of the tube are unequal, these are summed at the center of the tube as torque TTC, with a counter torque TBC on the inner ends of the torsion bars. The counter torques TBC is equal to the sum of the torques TBL an TBR on the torsion bars, and these torques are equal. Thus, unequal forces at the wheels produce a single torque at the center of the torque tube which is equally resiliently divided by the torsion bars. Thus, forces on the front wheels and rear wheels are equalized to provide a smooth and level ride. The front and rear wheel sets are independent but have equal spring loading and equal net damping. The two torsion bars in effect provide a single spring or resilient means resisting rotation or torque at the center of the torque tubes.

It may seem that the only wear in the truck is between the concave surfaces on the bolster and the torsion tubes. Wear on these parts, however, will have no adverse effect on the performance of the truck and will not allow the truck to go out of square. The torque tubes provide a solid tie across the truck and, together with the bolster, maintain the truck in a square relation.

I claim:

1. A railway truck wherein said truck has a pair of wheel and axle assemblies which are spaced from the transverse center line of the truck, said truck comprising a structural lever arm journaled near each end of each axle and extending toward the transverse center line to a free end, a pair of transverse torque tubes extending between and secured to the free ends of opposed lever arms of respective axles, spring means associated with a medial portion of each torque tube for resiliently resisting rotation of said medial portion, and a transverse bolster riding on said torque tubes.

2. The railway truck of claim 1 wherein said torque tubes are substantially in parallel, and said bolster embraces the torque tubes near the ends thereof to maintain said truck in a square condition.

3. The railway truck of claim 1 wherein said spring means comprises a pair of torsion bars carried in each torque tube, said torsion bars having inner ends secured to a central interior portion of said torque tube for rotation therewith, the outer ends of the torsion bars being secured near the outer ends of the bolster.

4. The railway truck of claim 2 wherein said bolster frictionally engages said torque tubes against rotary motion to provide damping.

5. The railway truck of claim 4 wherein said bolster has downwardly facing semicylindrical surfaces embracing the torque tubes.

6. The railway truck of claim 5 wherein said downwardly facing surfaces are near the ends of the bolster.

7. The railway truck of claim 6 wherein pairs of said downwardly facing surfaces are provided at each end of the bolster.

8. The railway truck of claim 1 wherein said bolster comprises a top horizontal and a medial vertical wall.

9. The railway truck of claim 1 wherein said bolster is of I beam construction.

10. The railway truck of claim 3 wherein said torsion bars are separately removable.

11. The railway truck of claim 3 wherein said torsion bars comprised faceted ends.

12. The railway truck of claim 3 wherein said torsion bars provide a solid transverse link between said bolster and torque tubes and limit relative lateral movement therebetween.

13. The railway truck of claim 4 wherein said bolster comprises a top transverse horizontal wall and a pair of spaced depending longitudinal vertical walls near each end, said vertical walls having surfaces which engage the torque tubes.

14. The railway truck of claim 13 wherein the torque tubes have ends extending beyond the respective lever arms, and said vertical walls of each said pair are located on the sides of one of said lever arms.

* * * * *